343-911 R AU 251 EX
1/19/88 XR 4,720,713

United States Patent [19]
Chang et al.

[11] Patent Number: 4,720,713
[45] Date of Patent: Jan. 19, 1988

[54] FIBER CERAMIC ANTENNA REFLECTOR

[75] Inventors: Stanley S. Chang, Palos Verdes Estates; Hui Bau, Hermosa Beach, both of Calif.

[73] Assignee: Hughes Aircraft Company, Los Angeles, Calif.

[21] Appl. No.: 915,366

[22] Filed: Oct. 6, 1986

[51] Int. Cl.[4] ..... H01Q 15/16
[52] U.S. Cl. ..... 343/912; 343/911 R; 343/DIG. 2
[58] Field of Search ..... 343/912, 911 R, 914, 343/DIG. 2

[56] References Cited

U.S. PATENT DOCUMENTS 3,917,773 11/1975 Gates, Jr. et al. ..... 343/911 R
4,188,358 2/1980 Withoos et al. ..... 343/912
4,605,935 8/1986 Kusano ..... 343/914

*Primary Examiner*—William L. Sikes
*Assistant Examiner*—Doris J. Johnson
*Attorney, Agent, or Firm*—S. M. Mitchell; M. J. Meltzer; A. W. Karambelas

[57] ABSTRACT

An antenna reflector having a parabolically curved reflecting surface is formed of a cellular ceramic material having ceramic fibers fused together in a rigid cellular structure. The body is formed by bonding or fusing a mass of silicon dioxide fibers together at their points of intersection with a fusing agent such as boron nitride in a sintering process, resulting in a fused array of fibers with cellular porosity intentionally distributed through the body to reduce its density. Other types of ceramic fibers can be used either alone or in combination with the silicon dioxide fibers. The antenna reflector finds particular utility in parabolic antennas for satellite microwave communications systems.

14 Claims, 5 Drawing Figures

FIBER CERAMIC ANTENNA REFLECTOR

BACKGROUND OF THE INVENTION

This invention relates to communications systems, and, more particularly, to antennas and antenna reflectors used therein.

Satellites are used to carry a large part of the private and government communications throughout the United States and the world. In the most basic satellite communications system, a ground sending antenna transmits a signal to a satellite receiving antenna mounted on a satellite in orbit above the earth. The signal is then transmitted by a transmitting antenna on the satellite to other spacecraft or to a ground receiving antenna. The signal can also be modified by the satellite, as by amplifying it before retransmission. Because the satellite is usually thousands of miles above the earth in a geostationary orbit, this procedure allows signals to be transmitted through the satellite to ground receiving stations thousands of miles from the ground sending station. This satellite transmission technique makes possible the beaming of television signals from central locations directly to local cable companies and backyard television dish receivers, as well as voice, data and other types of transmissions.

The two antennas located on the spacecraft are important components of this system, since all signals pass through the antennas on their way to and from the satellite. Each antenna typically includes an antenna reflector in the shape of a parabola and a transceiver at the focus of the parabola. A parabolic antenna has the feature that the energy of a wide signal beam received by the antenna reflector is directed to the focus of the parabola for receipt by the transceiver, or that energy radiated by a transceiver at the focus is directed in a parallel beam toward the ground by the antenna reflector. The antenna reflector is the part of the antenna that is most visible and recognizable, since the antenna reflector design is somewhat similar to the large dish seen in ground-based antennas.

The material used to construct the antenna reflector should have a number of characteristics, which heretofore have not been attained in antenna reflector materials. The material should be formable into a parabolic reflector with sufficiently high modulus of elasticity and strength to hold its shape precisely during launch, deployment and use. Distortions to the antenna reflector can cause significant degradation in the antenna performance and hence the quality of signal received by the ground station. The material should also have a low coefficient of thermal expansion and expand generally isotropically, to minimize the effects of heating and cooling as the antenna reflector passes from direct sunlight to shade and back into direct sunlight. When the antenna reflector is heated by the sun, it expands. The expansion ideally would be negligibly small, so that uneven heating would not cause the antenna reflector to warp, again resulting in degradation of signal. Even if the antenna reflector is heated evenly, anisotropic expansion can cause distortion. It is therefore desirable that the material of which the antenna reflector is constructed expand very little upon heating, and that such expansion be uniform.

The material of the antenna reflector must also meet the electrical design parameters required of all antenna reflectors. It must have a surface finish that does not interfere with the signal. Since the signal in some cases is a microwave signal with a very short wavelength of about one-fifth of a thousandth of an inch, the surface of the antenna must be even smoother than this to avoid interference with the signal. The material should have a low dielectric constant to minimize refraction of the signal by the antenna reflector, and a low dissipation factor to minimize attenuation or signal loss by the reflector itself. The material must allow a thin metallic coating to be applied to the surface of the antenna reflector to reflect the signal.

The antenna reflector must also meet new and evolving requirements for components used on satellites. The cost of boosting weight to orbit is high, so that the antenna reflector should be light and formed of a material of low density. The material should experience low outgassing in a space environment, since evolution of gas can interfere with operation of the satellite. It is also highly desirable that the material be stable to high temperatures to resist damage by intense beams of energy that might be directed against the antenna reflector, such as a high intensity laser beam that would burn holes in the antenna reflector, or even distort it substantially. High temperature capability would allow the antenna reflector to resist attack by lasers or other directed energy weapons without the need for specialized shielding and defense measures. Finally, it would be desirable to construct the antenna reflector of a material having characteristics such as density, surface structure, and composition that can be varied over ranges of values to permit antenna designers flexibility in their selection of antenna reflectors for different requirements, always using a basic material of construction with which they are familar and for which data is readily available.

This combination of characteristics has not heretofore been available. Existing antenna reflectors have been constructed of metals, composite materials or honeycomb structure, but these materials of construction do not have the combination of properties described above. Metals are heavy, have high coefficients of thermal expansion, cannot be readily tailored to different missions, and, in many cases, are susceptible to laser damage. Composites may have anisotropic coefficients of thermal expansion, may not be electrically acceptable, and are usually very suceptible to laser damage. Honeycomb materials have highly anisotropic expansion, may have unacceptably low mechanical properties, often cannot be made without surface porosity that can interfere with signals of short wavelength, and cannot be readily tailored to special requirements.

Accordingly, there is an ongoing need for an improved material for antenna reflectors, particularly for microwave spacecraft and satellite antenna reflectors for microwave signals. The present invention fulfills this need, and further provides related advantages.

SUMMARY OF THE INVENTION

The present invention is embodied in an antenna reflector that meets the structural, electrical, weight and other requirements for such a high-performance reflector. The material of the antenna reflector can be tailored to a range of modulus, strength and low density properties that allow it to be used for different types of applications. It can be prepared to the desired parabolic shape, and retains the dimensions accurately because of its low coefficient of thermal expansion and high degree of isotropy. The material can be metal coated by various techniques, and has the low dielectric constant and low dissipation factor required for high electrical signal reflection performance. The material has a high melting point that renders it resistant to disablement by laser energy.

In accordance with the invention, an antenna reflector comprises a solid body having at least one parabolically curved surface, the body being composed of a ceramic material wherein a plurality of ceramic fibers are bonded together at their points of intersection to form a rigid structure having open cells dispersed therethrough. The parabolically curved surface is normally covered with a metallic coating, preferably gold, copper, tungsten or alloys thereof. The ceramic fibers are primarily silicon dioxide, but other ceramic materials such as aluminum oxide and silicon carbide can be used either alone or in combination with each other. The fibers are preferably fused together with a fusing agent, such as a small amount of boron nitride. The density of the body is controllable by the amount of fusing agent used and the conditions of manufacture, and is preferably in the range of from about 0.1 to about 0.5 grams per cubic centimeter. The mechanical properties vary with density.

More specifically, an antenna reflector comprises a body having at least one parabolically curved plate surface, the body comprising an open celled mass of amorphous silicon dioxide ceramic fibers fused together at their points of intersection. The solid portion of the body is preferably a mixture of ceramic types, including silicon dioxide, aluminum oxide and silicon carbide. A most preferred composition of the body in weight percent is 74 percent silicon dioxide, 20 percent aluminum oxide, 3 percent boron nitride, and 3 percent silicon carbide, the silicon dioxide, aluminum oxide and silicon carnide being ceramic fibers that make up the walls of the cells and the boron nitride being the bonding agent that bonds the ceramic fibers to each other.

A process for preparing an antenna reflector comprises the steps of forming a slurry of ceramic fibers and fusing agent, removing excess liquid from the slurry to form a mat, pressing the mat to the desired parabolic shape, drying the pressed shape, and sintering the dried pressed shape to fuse the fibers together at their points of intersection. More specifically, an antenna reflector is fabricated by mixing a slurry of 250 milliliters of deionized water per 100 grams of fiber in a mixer operated at a speed such that the fibers are dispersed but not chopped; reducing the pH of the slurry to about 3 by the addition of acid and continuing the mixing: increasing the pH of the slurry to about 8 by the addition of sodium hydroxide solution and completing the mixing; washing the slurry under vacuum; mixing the bonding agent into the slurry; washing the slurry under vacuum and vacuum draining the slurry to form a mat; placing the mat into a press and pressing to the desired shape; drying the pressed shape in a drying oven; and sintering the dried shape. Drying is done in a drying oven at a gradually increasing temperature of about 70° C. to about 150° C. for about 12 hours, and sintering is done in a furnace at 1295° C. for about 90 minutes, using boron nitride as the fusing agent, with both heating and cooling accomplished in less than about 1 hour.

The resulting material is a fibrous mass bonded together at points of intersection with the aid of the fusing agent. The density of the fibrous mass can be controlled and varied by the processing, and most directly by the amount of fusing agent used. Higher amounts of fusing agent increase the degree of fusion of the fibers, resulting in higher density, modulus of elasticity and strength of the sintered final product.

It will now be appreciated that the antenna reflector of the invention presents a substantial advance in the art. A ceramic antenna reflector can be fabricated of fibers bonded together by fusing or other bonding procedure, so that the resulting structure has sufficient strength and elastic properties and is of a low, controllable density. The antenna reflector can be coated with a metal. The antenna reflector has a low, isotropic coefficient of thermal expansion, so that the fabricated dimensions are maintained during thermal cycling in a space environment. Acceptable electrical properties are also present. Other features and advantages of the present invention will be apparent from the following more detailed description, taken in conjunction with the accompanying drawings, which description illustrates, by way of example, the principles of the invention. BRIEF DESCRIPTION OF THE DRAWINGS FIG. 1 is a perspective view of a communications satellite receiving and transmitting signals;

DETAILED DESCRIPTION OF THE PREFERRED EMBODIMENT

Figure 1:
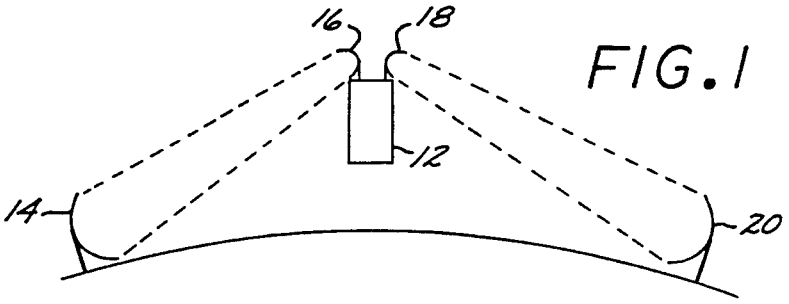
Figure 2:
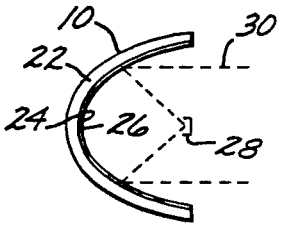
FIG. 2 is a side sectional view of a parabolic antenna reflector.

FIGS. 1 and 2 illustrate the general configuration and use of antenna reflectors 10 carried on a communications satellite 12. Referring to FIG. 1. signals are radiated from a ground transmitting antenna 14 to a satellite receiving antenna 16 on the satellite 12. The signal is amplified by electronics in the satellite 12, and then emitted by a satellite transmitting antenna 18 to a ground receiving antenna 20, which may be located thousands of miles from the ground sending antenna 14. In many commercial and government communications applications, the satellite 12 is in a geostationary orbit at an altitude of about 22,300 miles, above the equator of the earth. Such a satellite in geostationary orbit is stationary relative to locations on the ground, so that the antennas can also be relatively fixed and pointing at the same locations.

FIG. 2 illustrates in more detail an antenna of the type used on the satellite 12, which could be either the satellite receiving antenna 16 or the satellite transmitting antenna 18, but will be discussed in terms of the satellite receiving antenna 16 for clarity. (The present invention could be used in conjunction with ground antennas also, but these antennas do not have the stringent weight and performance requirements imposed on the much smaller satellite antennas.) The antenna 16 includes an antenna reflector 10 made of a solid body 22 having a parabolically curved reflecting surface 24. The parabolic reflecting surface is covered with a metallic layer 26 that is active in reflecting signals impinging on the reflector 10. A transceiver 28 is placed at the focus of the parabolic surface 24. A signal beam 30 transmitted from the ground sending station 14 impinges upon the metallized parabolic reflecting surface 24 and is reflected into the transceiver 28, thereby concentrating the energy of the beam 30 to a small area for collection by the transceiver 28. The satellite transmitting antenna 18 is constructed in a similar fashion, except that its transceiver emits a signal toward the antenna reflector, which then directs a beam toward the ground receiving station 20.

Figure 3:
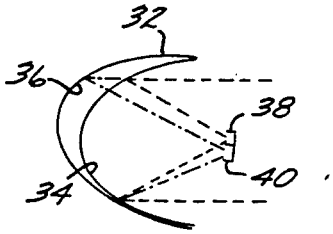
FIG. 3 is a side sectional view of a parabolic antenna reflector having two parabolic surfaces.

FIG. 3 illustrates another design for the antenna reflector, which doubles the communications capacity of the satellite. A dual-parabolic antenna reflector 32 includes a first parabolically curved reflecting surface 34 and a second parabolically curved reflecting surface 36 on the front and back faces of the reflector 32. The first reflecting surface 34 is metallically coated in such a way as to selectively reflect only a particular type of microwave signal, and the second reflecting surface 36 is metallically coated to reflect a second type. The focal point of the first reflecting surface 34 is different from that of the second reflecting surface 36. A first transceiver 38 for the first reflecting surface 34 is placed at the focus of the first reflecting surface 34, and a second transceiver 40 is placed at the focus of the second reflecting surface 36. Two different types of microwave signals can therefore be used, doubling the capacity of the satellite. The materials of construction of the present invention have the necessary electrical characteristics to allow fabrication and operation of this type of antenna reflector having two reflecting surfaces.

The illustrated unitary construction of antenna reflectors is most useful for small antennas. For larger antennas, the reflector may be segmented with a curved surface, so that the total antenna reflector is made up of a number of individual reflector segments connected and oriented by a support structure. This construction is within the meaning of the term antenna reflector as used herein.

Figure 4:
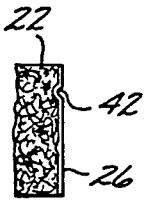
FIG. 4 is an enlarged schematic side sectional view of the surface of a fibrous ceramic antenna reflector.

In accordance with the present invention, the antenna reflector 10 is constructed of a ceramic material wherein a plurality of ceramic fibers are fused together at their points of intersection to form a rigid structure having open cells dispersed therethrough. A large number of ceramic fibers, each having a diameter of about 0.0001 to about 0.001 inches are formed into a mat and then fused at their intersecting points using a fusing agent and a sintering treatment. As illustrated in FIG. 4, the resulting structure retains the fibers in their original shape and size, but the fibers are rigidly fused together. Between the fused fibers, there is a large volume fraction of open space whose presence results in a low density of the fibrous ceramic material. The term "cell" is used herein to refer to the spaces enclosed by the bonded fibers, in the sense that a cellular type of enclosure for each open space could be defined geometrically. The use of the term cell should not be taken to suggest that the open spaces are regular in shape or uniform in size, and in fact the open spaces can vary greatly both in shape and size. The term cell should also not be taken to suggest that the space between the bonded fibers is closed within itself, and in fact for the most part the open spaces or cells are continuous to produce a solid of interconnected porosity in a structure termed an open cellular structure. In the sense used herein, the microstructure of the solid body is a large number of bonded fibers that define the walls of an open cellular structure.

The fibers used in the antenna reflector can be of any ceramic material that meets the producibility, structural, electrical and mechanical requirements of the antenna reflector. That is, the fibers should themselves be of low coefficient of thermal expansion, high melting point, low density, high modulus, and high strength, to impart these properties to the bonded material. They should also be electrically nonconducting, have a low dielectric constant, and have a low dissipation factor. Isotropy of the fibers themselves is not required, since the manner of combining the fibers in a generally random arrangement imparts isotropy to the fused array of fibers even when the fibers themselves are somewhat anisotropic.

The preferred fibers are silicon dioxide ($SiO_2$), which meet the above requirements and are readily available in short lengths. The silicon dioxide fibers can be fused together by various fusing agents. The preferred fusing agent is boron nitride, with fusing achieved by sintering.

The fibers must be in a form that has a low coefficient of thermal expansion. In the case of silicon dioxide fibers, the silicon dioxide material has an amorphous form with a very low coefficient of thermal expansion. Other forms of silicon dioxide fiber, such as the crystalline mineral form cristobalite, have a much higher coefficient of thermal expansion, and must be avoided in manufacturing and use of the antenna reflector. The higher coefficient of thermal expansion would lead to distortion of the antenna reflector and the generation of internal stresses that could reduce the strength of the part.

It is believed that many other types of ceramic fibers could be substituted for the silicon dioxide fibers in whole or in part, or used in conjunction with a mixture of silicon dioxide fibers and other fibers to achieve specifically tailored final properties. For example, aluminum oxide (alumina, or $Al_2O_3$) fibers and silicon carbide (SiC) fibers or powder have been incorporated in some instances to increase the strength and indentation hardness of the final product.

The fusing agent is a high temperature material which acts to bind the fibers together at their points of intersection and assists in the bonding of the fibers together at their points of intersection, thereby giving strength and rigidity to the final bonded structure. The fusing agent must withstand high elevated temperatures without permitting debonding of the fibers, since an important advantage of the ceramic material is to withstand the high temperatures created when the antenna reflector is struck by a laser beam. Since the ceramic material does not dissipate the heat of the laser beam quickly by conduction, it must withstand high temperatures. Boron nitride has been identified as the preferred fusing agent, since its presence permits the solid state sintering of the fibers together at their points of intersection. Other bonding agents can be used if they produce a similar result.

Figure 5:
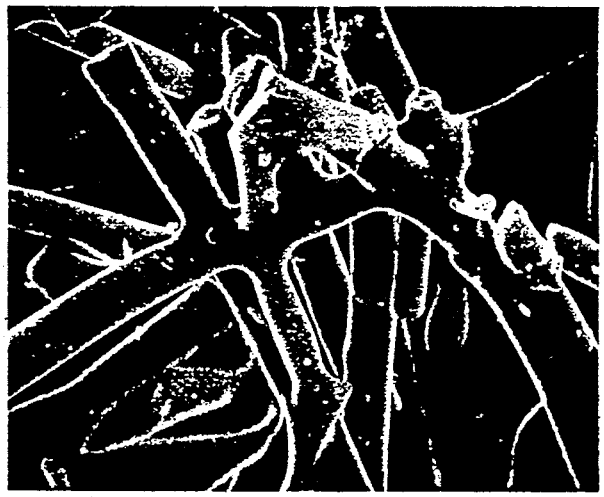
FIG. 5 is a photomicrograph of a fiber ceramic material used in the antenna reflector.

A cross section of the surface is depicted schematically in FIG. 4, and the actual microstructure is shown in FIG. 5. The fibers retain their essential fibrous structure after bonding is complete, so that the surface reveals a plurality of fibers projecting outwardly. The cells remain between the fused fibers and, at the surface, are manifested as a surface roughness 42 inherent in the material. The lateral extent of the surface roughness 42 varies with the nature of the processing and the fusing agent used. The metallic layer 26 is applied over the surface, and tends to fill in the roughness, resulting in a smoother surface. In some cases, patterns are defined in the metallic layer 26, and the depressions are exposed to the signal beam 30.

The lateral extent of the roughness 42 should have a size much less than the wavelength of the signal in the beam 30, so that the roughness 42 does not tend to trap the energy of the beam. The size of the roughness 42 can be reduced by increasing the as-bonded density of the ceramic material making up the antenna reflector 10, as for example by using greater pressing pressure during processing or using a greater amount of fusing agent to promote densification.

The metallic layer can be added by any convenient technique such as vapor metallization or physically attaching a metallic layer to the surface. The most common and preferred metallic materials for the metallic layer 26 are gold and copper, but metals having higher melting points, such as tungsten, can also be used to resist damage by a laser beam directed at the parabolic surface of the antenna reflector 10.

A procedure has been developed to fabricate pieces, such as antenna reflectors, of the fibrous ceramic material. In preparing pieces, fibers of a single type or combinations of types were weighed and then mixed together in a water slurry, with 250 milliliters of deionized water for each 100 grams of fiber. The mixer was operated for two minutes at a slow speed to disperse the bundles of fibers without chopping them. The pH of the slurry was reduced from 7 down to 3 with the addition of a 10 percent HCl solution, and mixing continued for 5 minutes. The pH of the slurry was increased to about 8 with the addition of a 10 percent NaOH solution, and mixing continued for 5 minutes.

The slurry was poured into a vacuum liquid extraction device, wherein a cylinder was mounted upon a vacuum flask, with a filter between the two. A vacuum of 44.8 torr was maintained in the flask, and the slurry was poured into the cylinder. The liquid was removed into the vacuum flask and the fibrous material retained on the filter. The retained material was washed with a volume of deionized water, which was also removed into the vacuum flask.

The wet compact was removed and mixed for two minutes with 250 ml of deionized water for each 100 grams of fiber and the fusing agent. In this work, boron nitride was used as the fusing agent. The mixture was placed in the cylinder above the vacuum flask and the liquid removed.

The wet but drained mixture was then placed into a die of the desired final shape and pressed under a load using a hydraulic press to form a mat. The pressed mat had sufficient strength for handling in subsequent operations.

The pressed mat was placed into a drying oven operating at 70° C., and the temperature gradually increased over a 6 hour period to 150° C. The material was held at this temperature for an additional 6 hours to ensure than all moisture within the pressed mat had been removed. Removal of the moisture is thought to be important, because of the presence of moisture promotes formation of cristobalite in subsequent sintering. At the beginning of this drying step, the wet mat typically contains up to about 75 percent by weight water. If the water is removed too quickly, it causes the compact to expand and the fibers to break, weakening the final product.

The dried piece was then sintered in air at a temperature of 1295° C. for 90 minutes. The piece was heated to this temperature before sintering in less than 1 hour, and cooled after sintering to room temperature in less than 1 hour.

A number of compositions and processing conditions were evaluated to determine the most preferred composition for the fibrous ceramic of the antenna reflector, with the processing conditions as indicated previously. The starting materials were as follows:

Silicon dioxide fibers were amorphous, 99.7 percent pure material, with a diameter of about 1.4 micrometers and a length to diameter ratio ranging from 0.07 to 9.3. (Thus, the term "fiber" is seen to be used in a generic sense, and can cover elements which have a length to diameter ratio less than 1.) The density of the fibers, which is to be distinguished from the density of the final product, was 2.32 grams per cubic centimeter. The fibers were obtained as Q-fibers from Johns Manville company.

Aluminum oxide fibers were crystalline material of 95 percent $Al_2O_3$ and 5 percent $SiO_2$, with a diameter of 3 micrometers. The density was 3.40 grams per cubic centimeter, and the fibers were supplied by Saffil.

Silicon carbide whisker fibers were alpha silicon carbide, 99.1 percent pure material. They had a diameter of about 0.6 micrometers and a length to diameter ratio of from 17 to 133. The density of the fibers was 3.2. The fibers were obtained as SILAR SC-9 material from the Silag division of Arco Metals.

Boron nitride powder fusing agent was 99.5 percent purity with a mean diameter of less than 43 micrometers. Its density was 2.25, and the powder was obtained from AESAR Chemica.

A number of samples were made, and the materials used and conditions are summarized in the following table. In preparing the table, the hardness value was determined by pressing a 1.02 millimeter diameter probe into the surface of the piece and then measuring the indentation strength using a Shore A hardness gauge. A dial indicator measured the resistance of the material to the puncture. The relative specific strength value was obtained by dividing the indentation strength (Shore A hardness) by the bulk geometric density.

| No. | Composition[1] (weight pct) | Density gm/cubic cm | Pressing Press (psi) | Hardness Shore A | Specific Strength |
|---|---|---|---|---|---|
| 1 | 97-0-3-0 | — | 133.7 | 70 | — |
| 2 | 78-22-0-0 | 0.68 | 66.8 | 88 | 129 |
| 3 | 76-21-3-0 | 0.24 | 10.1 | 48 | 200 |
| 4 | 76-21-3-0 | 0.24 | 10.1 | 53 | 221 |
| 5 | 78-22-0-0 | 0.21 | 10.1 | 28 | 133 |
| 6 | 76-21-3-0 | 0.44 | 33.7 | 90 | 205 |
| 7 | 78-22-0-0 | 0.44 | 33.7 | 50 | 114 |
| 8 | 74-21-3-2 | 0.24 | hand | 35 | 146 |
| 9 | 74-21-3-2 | 0.25 | hand | 55 | 220 |
| 10 | 76-21-3-0 | 0.11 | hand | — | — |
| 11 | 80-14-6-0 | 0.32 | — | 60 | 219 |
| 12 | 78-19-3-0 | 0.25 | — | 40 | 160 |
| 13 | 80-11-6-3 | 0.49 | — | 60 | 122 |
| 14 | 75-19-3-3 | 0.26 | — | 40 | 154 |
| 15 | 75-19-3-3 | 0.23 | — | 55 | 239 |
| 16 | 73-18-3-6 | 0.21 | 7.2 | 55 | 238 |
| 17 | 69-21-3-7 | 0.12 | squeezed wet | 15 | 125 |
| 18 | 71-20-3-6 | 0.23 | 7.3 | 56 | 239 |
| 19 | 71-20-3-6 | 0.19 | 7.3 | 45 | 236 |
| 20 | 74-20-3-3 | 0.23 | 9.9 | 50 | 218 |

[1]in the order silicon dioxide-aluminum oxide-boron nitride-silicon carbide

From these data, it was determined that additions of aluminum oxide and silicon carbide fibers increase the strength and indentation hardness of the fibrous ceramic material. The flexural strengths of specimens having silicon carbide were in the range of 100–200 pounds per square inch (psi), while the strengths of specimens without silicon carbide were in the range of about 70 psi.

Additions of silicon carbide of greater than about 3 percent do not yield further indentation strength increases, and as a result this value is thought to be the optimum silicon carbide content because further additions increase weight without increasing strength.

The boron nitride fusing agent is present to fuse the silicon dioxide and aluminum oxide fibers together. Increasing amounts of boron nitride increase the density of the final sintered material. For example, 6 percent of boron nitride increased the density to as high as 0.49 grams per cubic centimeter.

The compaction load also helps determine the final density. The higher loads increased the indentation strength but also increased the density. The optimum compaction pressure was found to be about 10 pounds per square inch, which resulted in a bulk density of 0.23 grams per cubic centimeter and a hardness of 50.

Because the density of the final product is controllable, solids can be fabricated having intentionally nonuniform densities. Graded layers of differing densities parallel to a surface could be designed into the structure for modified antenna performance. Selected regions can be given a higher density for increased strength, as for example at attachment points.

The processing procedure and compositions described resulted in a negligably small amount of cristobalite formation, as desired. The presence of cristobalite is deleterious to properties due to the large volume change which occurs in the crystalline form when heating in the range of 200 to 270° C. X-ray diffraction patterns of the specimens were prepared and analyzed. They showed no cristobalite in the specimens.

Based upon the optimization of the composition and processing, the most preferred composition of the fibrous ceramic material in weight percent is found to be about 74 percent silicon dioxide, 20 percent aluminum oxide, 3 percent boron nitride, and 3 percent silicon carbide, pressed at a pressure of about 10 psi.

The antenna reflector of the present invention thus has the acceptably high strength and low density needed for use in a satellite communications system. It is formed of ceramic materials which have an inherently low coefficient of thermal expansion and are assembled in a manner that produces isotropic expansion properties. The reflector is transparent to radio frequency signals, and has a low dielectric constant for low reflection of the signal and a low dissipation factor for low attenuation of the signal. The surface of the ceramic material may be readily coated with a metallic layer to reflect the signal, and the reflector can be made with sufficiently small surface irregularities that it is suitable for reflection of micrometer wavelength microwave signals. Various types of fibers can be incorporated into the solid reflector body, so that it can be tailored to meet a range of operating requirements. Thus, the present invention represents an important advance in the art of spacecraft antenna reflectors. Although a particular embodiment of the invention has been described in detail for purposes of illustration, various modifications may be made without departing from the spirit and scope of the invention. Accordingly, the invention is not to be limited except as by the appended claims.

What is claimed is:

1. An antenna reflector comprising a solid body having at least one parabolically curved surface, said body being composed of a ceramic material wherein a plurality of ceramic fibers are bonded together at their points of intersection to form a rigid structure having open cells dispersed therethrough.

2. The antenna reflector of claim 1, wherein said body has a second parabolically curved surface with a focus different from that of said one parabolically curved surface.

3. The antenna reflector of claim 1, wherein said parabolically curved surface is covered with a metallic coating.

4. The antenna reflector of claim 1, wherein said parabolically curved surface is covered with a metallic coating wherein the metal is selected from the group consisting of gold, copper and tungsten, and alloys thereof.

5. The antenna reflector of claim 1, wherein said ceramic fibers include silicon dioxide fibers.

6. The antenna reflector of claim 1, wherein said ceramic fibers include silicon dioxide fibers and aluminum oxide fibers.

7. The antenna reflector of claim 1, wherein said ceramic fibers are fused together by a fusing agent.

8. The antenna reflector of claim 7, wherein said fusing agent is boron nitride.

9. An antenna reflector, comprising a body having at least one parabolically curved plate surface, said body being composed of an open celled mass of amorphous silicon dioxide ceramic fibers fused together at their points of intersection.

10. The antenna reflector of claim 9, wherein said open-celled mass also includes aluminum oxide ceramic fibers fused together with said silicon dioxide fibers.

11. The antenna reflector of claim 9, wherein said the parabolically curved plate surface is covered with a metallic coating.

12. The antenna reflector of claim 9, wherein the density of the body is from about 0.1 to about 0.5 grams per cubic centimeter.

13. The antenna reflector of claim 9, wherein the composition of said body in weight percent is about 74 percent silicon dioxide, 20 percent aluminum oxide, 3 percent boron nitride, and 3 percent silicon carbide.

14. The antenna reflector of claim 9, wherein said body includes at least two reflector segments and a support structure connecting and orienting said reflector segments.

* * * * *